US007066163B2

(12) United States Patent
Kassner

(10) Patent No.: US 7,066,163 B2
(45) Date of Patent: Jun. 27, 2006

(54) IGNITION SYSTEM FOR AN INTERNAL COMBUSTION ENGINE

(75) Inventor: Uwe Kassner, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/147,580

(22) Filed: Jun. 7, 2005

(65) Prior Publication Data

US 2005/0284455 A1 Dec. 29, 2005

(30) Foreign Application Priority Data

Jun. 28, 2004 (DE) ..... 10 2004 031 064

(51) Int. Cl.
*F02P 15/00* (2006.01)

(52) U.S. Cl. ..... 123/647; 123/169 PA; 324/402

(58) Field of Classification Search ..... 123/169 PA, 123/634, 635, 647; 313/118; 73/116, 714; 324/380, 393, 399, 402
See application file for complete search history.

(56) References Cited

U.S. PATENT DOCUMENTS

| | | | | |
|---|---|---|---|---|
| 5,111,790 | A * | 5/1992 | Grandy | 123/635 |
| 6,122,971 | A * | 9/2000 | Wlodarczyk | 73/705 |
| 6,466,876 | B1 * | 10/2002 | Broehan et al. | 702/35 |
| 6,570,304 | B1 * | 5/2003 | Okazaki et al. | 313/118 |
| 6,655,367 | B1 * | 12/2003 | Ohkama et al. | 123/635 |
| 6,883,509 | B1 * | 4/2005 | Porter et al. | 123/647 |
| 2005/0150301 | A1 * | 7/2005 | Skinner et al. | 73/714 |

FOREIGN PATENT DOCUMENTS

JP 2002-48042 * 2/2002

* cited by examiner

*Primary Examiner*—T. M. Argenbright
(74) *Attorney, Agent, or Firm*—Kenyon & Kenyon LLP

(57) ABSTRACT

An ignition system into which signal lines and an evaluating circuit are integrated, so that the signals of a sensor integrated into a spark plug may be passed on, without additional mounting expenditure and space requirement, to a control unit of the engine control.

7 Claims, 2 Drawing Sheets

IGNITION SYSTEM FOR AN INTERNAL COMBUSTION ENGINE

BACKGROUND INFORMATION

In the course of use regulations and emission rules for internal combustion engines, that are becoming stricter, the recording of measured variables in the combustion chamber of an internal combustion engine is becoming more important all the time. An example for this is a so-called combustion chamber pressure sensor, with the aid of which, among other things, the combustion process may be monitored and controlled.

In order to be able to install such sensors, at the least space requirement and without changes in the internal combustion engine, for example, pressure sensors in the form of piezoceramic elements or of quartz are integrated into the spark plug of an internal combustion engine. The load generated in the piezoceramic element or the quartz is proportional to the impressed pressure in the combustion chamber. Since these sensors generate an output signal by their high impedance, which cannot be simply transmitted to the engine control unit, a signal conversion is required. This signal conversion usually takes place by a load amplifier or an impedance converter. The semiconductor components required for this are generally not able to be accommodated in the spark plug.

SUMMARY OF THE INVENTION

According to the present invention, the evaluation devices (signal converters) are integrated into the ignition system of the internal combustion engine. In this context, it is provided according to the present invention, in an ignition system for an internal combustion engine having an output stage for an ignition coil, the ignition coil having a high voltage connection to contact a spark plug, to provide, in the immediate spatial vicinity of the high voltage connection, a signal connection for contacting at least one sensor situated at the spark plug, and to connect a signal line at the signal connection which connects the signal connection to an evaluating circuit. Thereby it is possible, in a relatively simple manner, to integrate a sensor into the spark plug without having to make changes in the internal combustion engine, and to supply the output signals of this sensor to an appropriate evaluation circuit. In other words: By mounting the high voltage connection onto the spark plug,the signal connection also is simultaneously connected to the sensor integrated at the spark plug.

In one especially advantageous embodiment of the ignition system according to the present invention it is provided that the output stage, the ignition coil and the high voltage connection be combined into one component. This component is usually designated as being a rod-type ignition coil. It uses the spark plug well in the cylinder head of the internal combustion engine for accommodating the actual spark coil, and at its upper end it has a housing which includes the output stage for the ignition coil and a plug.

In a particularly advantageous embodiment of the present invention, the signal line is encapsulated with the ignition coil or connected in another way. Thereby the signal line is to a great extent kept away from influences by the surroundings, care should be taken, however, that there is suitable shielding between signal line and ignition coil or the other components of the ignition system.

In an especially advantageous embodiment of the ignition system according to the present invention, the output stage of the ignition coil has an electrical plug connection for connecting to a control unit, at least one contact element of the electrical plug connection electrically connecting the evaluating circuit to the control unit.

This ensures, first of all, that without an additional plug connector, the evaluating circuit is first of all supplied with electrical energy and secondly, that the output variables of the evaluating circuit are able to be transmitted to the control unit.

It is particularly advantageous if a first contact element of the electrical plug connection supplies the evaluating circuit with electrical energy, and if a second contact element of the electrical plug connection establishes a signal connection between the evaluating circuit and the control unit.

It leads to especially compact construction and favorable manufacturability if the output stage of the ignition coil and the evaluating circuit are combined into one module. This may be done in a most particularly advantageous way by positioning the output stage and the evaluating circuit on a common printed-circuit board.

According to the present invention, it may also be provided that, between the ignition coil and the high voltage connection, an ignition cable is provided, and that a signal line is present in the ignition cable. By doing this, the ignition system according to the present invention is not limited to ignition systems having so-called rod ignition coils, but may, in principle, be installed in the case of the most varied kinds of embodiments of ignition systems.

DETAILED DESCRIPTION

Figure 1:
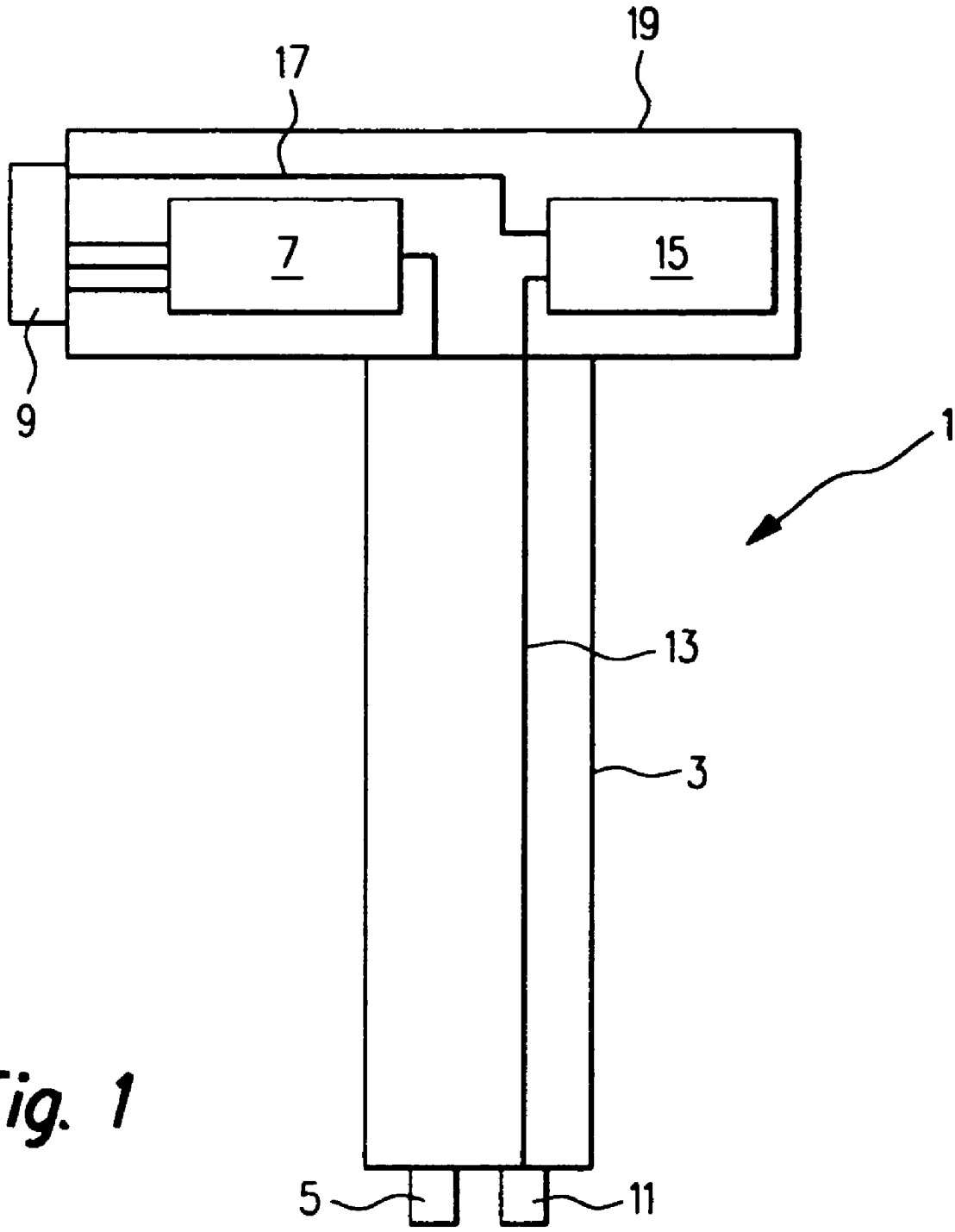
FIG. 1 shows a schematic representation of a first exemplary embodiment of an ignition system according to the present invention.

A so-called rod ignition coil is shown schematically in FIG. 1. In this context, the rod ignition coil, designated in its entirety by reference numeral 1, is made up of actual ignition coil 3 having a primary winding and a secondary winding, as well as an iron core (not shown). At its lower end, ignition coil 3 has an high voltage connection 5. Using this high voltage connection 5, rod ignition coil 1 is plugged onto a spark plug that is not shown.

At the end of the rod ignition coil lying opposite the high voltage connection 5 an output stage 7 is provided, which activates ignition coil 3. The electrical connections between output stage 7, ignition coil 3 and high voltage connection 5 are not shown in FIG. 1.

Output stage 7 is connected to an electrical plug connector 9. Into the electrical plug connector 9, a cable from the control unit of the internal combustion engine (not shown) may be inserted, so that output stage 7 may be controlled by the control unit of the internal combustion engine. Components electrical plug connection 9, output stage 7, ignition coil 3 and high voltage connection 5 are part of a so-called electronic ignition system.

In the ignition system according to the present invention, shown in FIG. 1, it is provided that a signal connection 11 is present, in addition to high voltage connection 5. When rod ignition coil 1 is plugged onto the spark plug (not shown) with its high voltage connection 5, signal connection 11 contacts a sensor which is integrated into the spark plug (not shown). Starting at signal connection 11, there runs all the way through ignition coil 3 a signal line 13 to an evaluating circuit 15. Evaluating circuit 15 is used to process the output signals of the sensor integrated into the spark plug that is not shown, so that this signal may be evaluated by the control unit of the engine control or in another manner.

In order to develop the connection of the evaluating circuit to the control unit (not shown) in as simple a manner, at least one contact (pin) is provided at electrical plug connector 9, which electrically connects evaluating circuit 15 to electrical plug connector 9 via a line 17. This makes it possible, by plugging a cable of the control unit into electrical plug connector 9, to connect not only output stage 7 but also evaluating circuit 15 to the control unit that is not shown.

Evaluating circuit 15 may be developed, for example, as a load amplifier or an impedance converter. In the exemplary embodiment shown in FIG. 1, it is especially advantageous that output stage 7 and evaluating circuit 15 are situated in immediate spatial vicinity, and may consequently be combined to form a module in a common housing 19.

In a particularly advantageous manner, output stage 7 and evaluating circuit 15 may even be arranged on a common printed-circuit board.

It goes without saying that, in line 17, which connects electrical plug connector 9 to evaluating circuit 15, a plurality of cables may also be present. For example, a first cable may be used for supplying evaluating circuit 15 with electrical energy, while an additional cable passes on the sensor signals processed by evaluating circuit 15 to the control unit (not shown).

Figure 2:
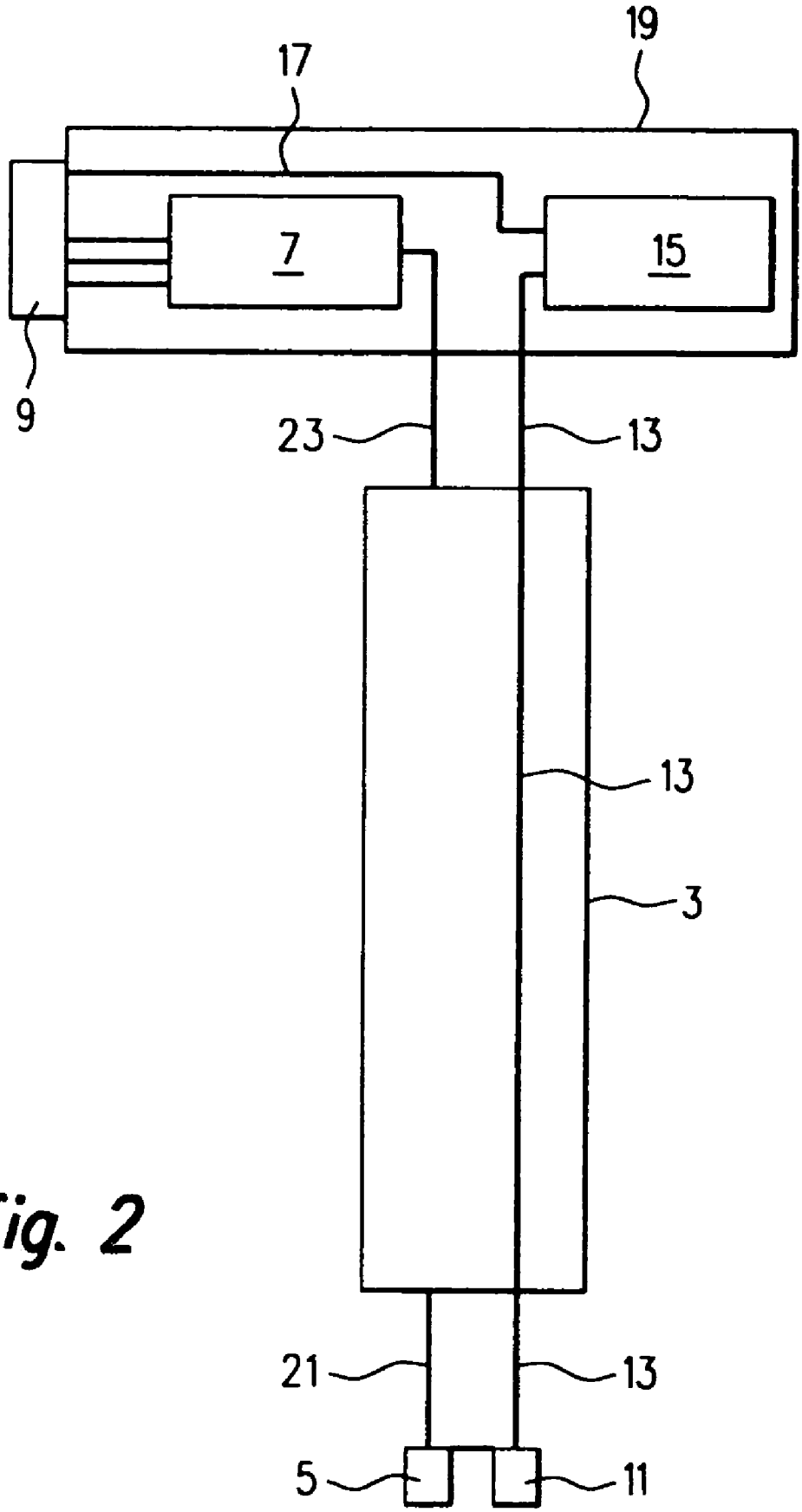
FIG. 2 shows a second exemplary embodiment of an ignition system according to the present invention.

Of course, it is also possible to use the advantages of the present invention in the case of an ignition system that does not have a so-called rod ignition coil. An exemplary embodiment of such an ignition system is shown schematically in FIG. 2. In this context, same components are provided with the same reference numerals. An important difference between ignition systems according to FIG. 1 and FIG. 2 is that high voltage connection 5 in the exemplary embodiment according to FIG. 2 is not situated directly at ignition coil 3, but between ignition coil 3 and high voltage connection 5 a high voltage line 21 is provided. In a corresponding manner, signal line 13 is run out of ignition coil 3 and is run all the way to signal connection 11.

This makes it possible not to position ignition coil 3 in the immediate vicinity of the cylinder head of the internal combustion engine, but to position it at a suitable place in the engine compartment.

Furthermore, in the exemplary embodiment according to FIG. 2, ignition coil 3 is not directly connected to output stage 7 and evaluating circuit 15. In this case too, the electrical connection between ignition coil 3 on the one hand, and output stage 7 on the other hand, is produced via an electrical line 23. Electrical line 23 is preferably designed in a multi-core manner, one core being a part of signal line 13. Thereby an additional degree of freedom comes about in the spatial arrangement of the components of the ignition system according to the present invention.

In all the specific embodiments one should, of course, make sure that signal line 13, signal connection 11 and evaluating connection 15, as well as line 17, are shielded sufficiently against electromagnetic interferences which may originate in the ignition system.

What is claimed is:

1. An ignition system for an internal combustion engine comprising:

an ignition coil having a high voltage connection to contact a spark plug;

an output stage for the ignition coil;

a signal connection for contacting at least one sensor situated on the spark plug, the signal connection being situated in an immediate spatial vicinity of the high voltage connection;

an evaluating circuit; and a signal line connecting the signal connection to the evaluating circuit;

wherein the output stage has an electrical plug connector for connecting to a control unit, and at least one contact element of the electrical plug connector electrically connects the evaluating circuit to the control unit.

2. The ignition system according to claim 1, wherein the output stage, the ignition coil and the high voltage connection are combined to form one component unit.

3. The ignition system according to claim 1, wherein the signal line is one of (a) encapsulated with and (b) connected to the ignition coil.

4. The ignition system according to claim 1, wherein a first contact element of the electrical plug connector supplies the evaluating circuit with electrical voltage, and a second contact element of the electrical plug connector establishes a signal connection between the evaluating circuit and the control unit.

5. The ignition system according to claim 1, wherein the output stage and the evaluating circuit are combined to form one module.

6. The ignition system according to claim 5, wherein the output stage and the evaluating circuit are situated on a common printed-circuit board.

7. The ignition system according to claim 1, further comprising an ignition cable situated between the ignition coil and the high voltage connection, a signal line being present in the ignition cable.

* * * * *